US005335310A

United States Patent [19]

Novy et al.

[11] Patent Number: 5,335,310

[45] Date of Patent: Aug. 2, 1994

[54] MODULAR HEATING ASSEMBLY WITH HEATING ELEMENT SUPPORT TUBES DISPOSED BETWEEN HANGERS

[75] Inventors: George Novy, Danbury; Angelo Makris, Southbury, both of Conn.

[73] Assignee: The Kanthal Corporation, Bethel, Conn.

[21] Appl. No.: 679

[22] Filed: Jan. 5, 1993

[51] Int. Cl.[5] ..... H05B 3/00; F24H 9/00; F24D 19/02

[52] U.S. Cl. ..... 392/434; 392/432; 219/550; 219/532; 219/537; 338/304; 338/319; 373/128

[58] Field of Search ..... 392/432-434; 219/550, 532, 546, 539, 536, 537; 338/302-305, 315, 316, 318-320; 373/128-130, 119, 127

[56] References Cited

U.S. PATENT DOCUMENTS

| | | | |
|---|---|---|---|
| 561,294 | 6/1896 | Thomas | 338/302 |
| 601,585 | 3/1898 | McElroy | 338/319 |
| 668,442 | 2/1901 | Eastwood | 338/302 |
| 1,134,818 | 4/1915 | Campbell | 338/321 |
| 1,190,780 | 7/1916 | McElroy | 338/319 |
| 1,535,901 | 4/1925 | Clark . | |
| 1,654,314 | 12/1927 | Tuttle . | |
| 1,718,106 | 6/1929 | Bolsinger . | |
| 2,235,764 | 3/1941 | Hynes . | |
| 4,007,369 | 2/1977 | Dietze | 219/390 |
| 4,417,346 | 11/1983 | Giler . | |

FOREIGN PATENT DOCUMENTS

| | | | |
|---|---|---|---|
| 260130 | 10/1926 | United Kingdom | 338/302 |
| 290134 | 5/1928 | United Kingdom | 338/316 |
| 591752 | 8/1947 | United Kingdom | 338/316 |

*Primary Examiner*—Bruce A. Reynolds
*Assistant Examiner*—John A. Jeffery
*Attorney, Agent, or Firm*—Lawrence Hager

[57] ABSTRACT

A modular type heating unit or assembly having particular utility for use in a high temperature electric furnace, preferably in a group arrangement, comprises an insulating fibrous refractory block, a pair of spaced apart support rods, inner and outer support tubes and a heating element. Both the heating element and the support rods are formed of alloys to enable operation at relatively high temperatures. By utilizing this concept of modular element/insulation units, furnaces can be operated at relatively higher temperatures than is currently possible for exposed electrical element type furnaces.

14 Claims, 5 Drawing Sheets

MODULAR HEATING ASSEMBLY WITH HEATING ELEMENT SUPPORT TUBES DISPOSED BETWEEN HANGERS

FIELD OF INVENTION

This invention relates to relatively high temperature electric furnaces and, more particularly, to a modular building assembly for an electrical heating unit having improved construction and function.

BACKGROUND OF THE INVENTION

Typically, an electrical heating element is supported between support brackets which are mounted unto a prefabricated panel block. The support brackets are embedded in the fiber panel and the fiber panel is mounted unto the walls, of the furnace. Such panel (building) blocks are available from the Kanthal Corporation as ceramic fiber vacuum formed panels.

Such high temperature melting furnaces are required in laboratories and in industry where temperatures above 1800 degrees Fahrenheit are required.

Heretofore, the prior art support systems have not been successful in eliminating the problems of bunching, creeping and sagging of the metallic heating elements.

BRIEF STATEMENT OF THE PRIOR ART

The prior art includes numerous types of furnaces, heaters and electric heating elements.

The prior art is also replete with attempts to support the electric heating elements in such a way as to eliminate element failure while enabling easy assembly and dissassembly. One such attempt, shown in U.S. Pat. No. 2,235,764 issued Mar. 18, 1941 to Lee P. Hynes shows a flat metal bar having an opening in each end thereof. The longitudinal edges of the bar are provided with shoulders. Slidably mounted upon the bar are a plurality of dielectric sections of porcelain.

Another prior art patent of interest with regard to the present invention is U.S. Pat. No. 1,654,314 issued Feb. 5, 1927 to R. X. Tuttle. This reference describes a base member having outwardly diverging arms. A threaded post is mounted on each arm. Loosely arranged on the posts are cores. Resistance coils are wound upon the cores. Apparent shortcoming of this therapeutic lamp device construction are that it is unsuitable for use in a furnace environment and requires relatively complex, numerous components laboreous to assemble.

Other prior art patents of some interest include U.S. Pat. Nos.: 1,654,313 Dec. 27, 1927 to R. X. Tuttle, 1,718,106 issued Jun. 18, 1929 to S. S. Bolsinger; 1,693,133 issued Nov. 27, 1928 to P. R. G. Bredermann; 1,535,901 issued Apr. 28, 1925 to W. Clark; 1,459,307 issued Jun 19, 1923 to C. A. Laise et al; 1,358,219 issued Nov. 9, 1920 to E. T. Lancaster; 4,417,346 issued Nov. 22, 1983 to Roger R. Giler; and 4,007,369 issued Feb. 8, 1977 to Wolfgang Dietye.

These patents are mentioned as being representative of the prior art and other pertinent patents/references may exist. None of the above cited patents are deemed to affect the patentability of the present claimed invention.

In contrast to the prior art, the present invention provides an improved heating unit assembly for an electric type furnace which utilizes an inner and outer ceramic like support tube, a high temperature alloy used to construct both the support mechanism and the heating elements. The heating element(s) is mounted to the support system via the ceramic tubes which support the coil element in such a way as to substantially eliminate the common problems, i.e. bunching, creeping and sagging etc., of the prior art. Further, the present invention enables the mounting of each modular heating unit or Gyro-block in virtually any positional orientation on the furnace walls and ceiling, e.g. vertical and horizontal placement, and substantially without element failure due to sagging and short-outs.

SUMMARY OF THE INVENTION

Generally speaking, the invention comprises a modular heating unit having a ceramic support system with improved functionalism.

The heating unit basically comprises: a block shaped fiber panel; a pair of spaced apart support members each having a rod shaped portion extending through the body of said fiber panel with a protruding end for being affixed to a furnace wall, and being formed at their respective other ends to supportingly accommodate a respective end portion of an inner ceramic tube or bar like member; an outer ceramic tube member dimensioned for receiving through its inner tube space said inner ceramic tube with the end portions of said inner ceramic tube projecting outwardly at each end of said outer ceramic tube member; a pair of ceramic washer shaped spacer members each placed about an opposite end portion of said outer ceramic tube member; a heating element formed of resistance heating alloy(s) and being supportingly held in place between said spacer members on said outer ceramic tube member, said heating element having an electrical connector affixed thereto for conducting electrical current to said heating element.

A modular heating unit or Gyro-Block generally is constructed to include a plurality of heating elements each being supported on a respective dual ceramic tube support system as noted above.

OBJECTIVES

Accordingly, an object of the invention is to provide a new and improved heating unit for an electric type furnace.

It is a further object of the invention to provide a modular heater having an improved assembly.

It is a further object of the invention to provide a modular heater assembly which utilizes a new and improved support mechanism formed of high temperature alloy.

It is a further object of the invention to provide a new and improved heater element support system which utilizes an inner and outer ceramic support tubes.

It is a further object of the invention to provide an improved support system which enables the heating elements to be spaced relatively distally from the insulating fiber panel for improved heater function.

It is a further object of the invention to provide the use of both the heating elements and the support rods therefore which are formed of high temperature alloy.

It is a further object of the invention to provide an improved mounting assembly to facilitate low cost assembly and disassembly, i.e., replacement, of each heating element.

It is a further object of the invention to provide a new and improved heating assembly which enables operation at relatively high temperatures with relatively few burn-outs or malfunctions.

It is a further object of the invention to provide a heating assembly for high temperature element systems which can be mounted in various positions.

It is a further object of the invention to provide an electric furnace modular heating assembly at relatively low cost.

Another object of the invention is to provide a new and improved support system for heating elements which utilizes alloy support rods specially heat treated prior to assembly with the other constituent components of the modular heat unit.

Yet another object of the invention is to provide a new and improved modular heating assembly for a high temperature electric furnace wherein a support rod extends outwardly from both sides of an insulating block with one end adapted for being affixed to a wall or ceiling surface of the furnace, and the other outwardly projecting and being adapted to support a ceramic tube.

Other objects and advantages will be apparent to those skilled in the art from the detailed description of the drawings.

BRIEF DESCRIPTION OF THE DRAWINGS

The accompanying drawings illustrate the preferred embodiments of the present invention by way of example. Like numerals refer to like parts throughout.

DETAILED DESCRIPTION OF THE INVENTION

Figure 1:
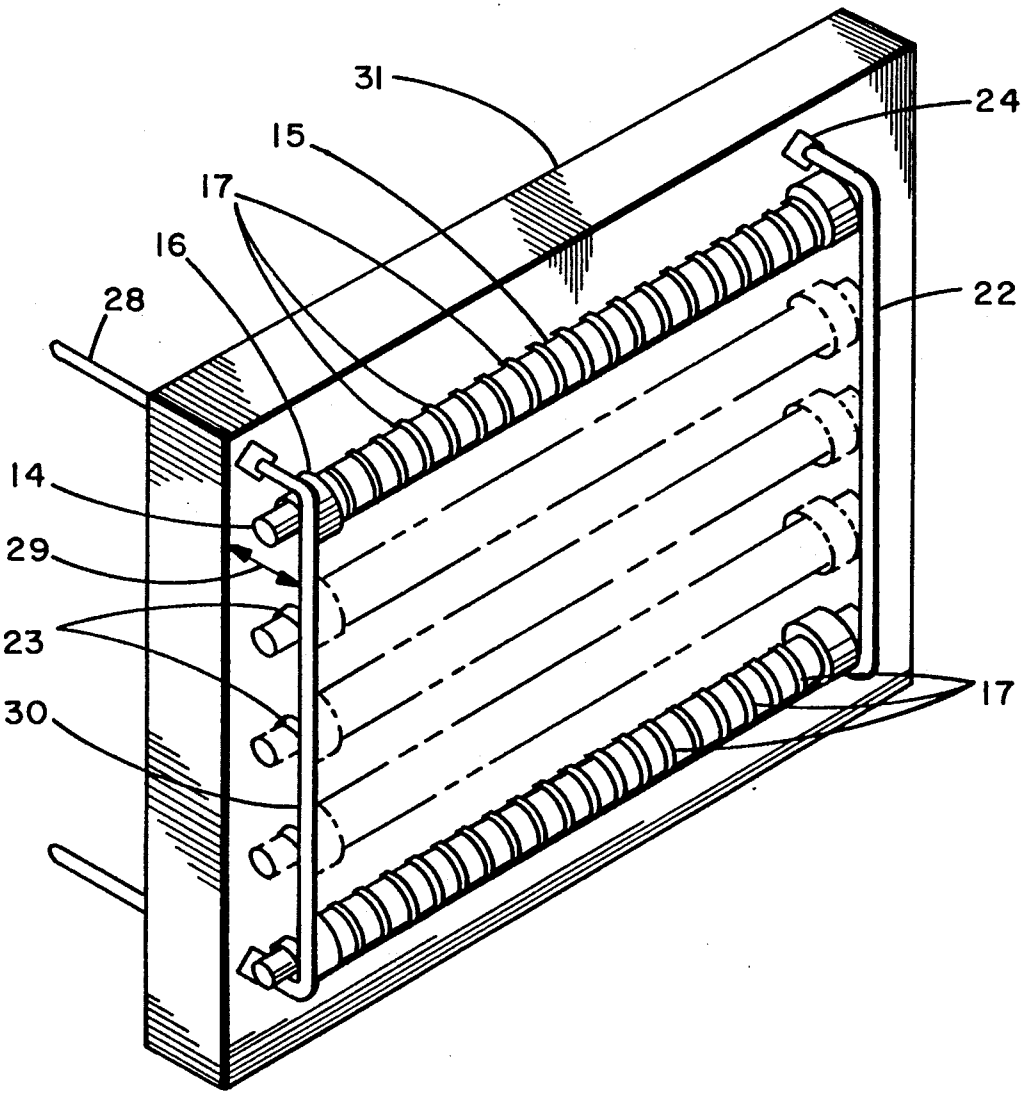
FIG. 1 is a perspective view of a modular heating unit constructed in accordance with the invention.
Figure 2:
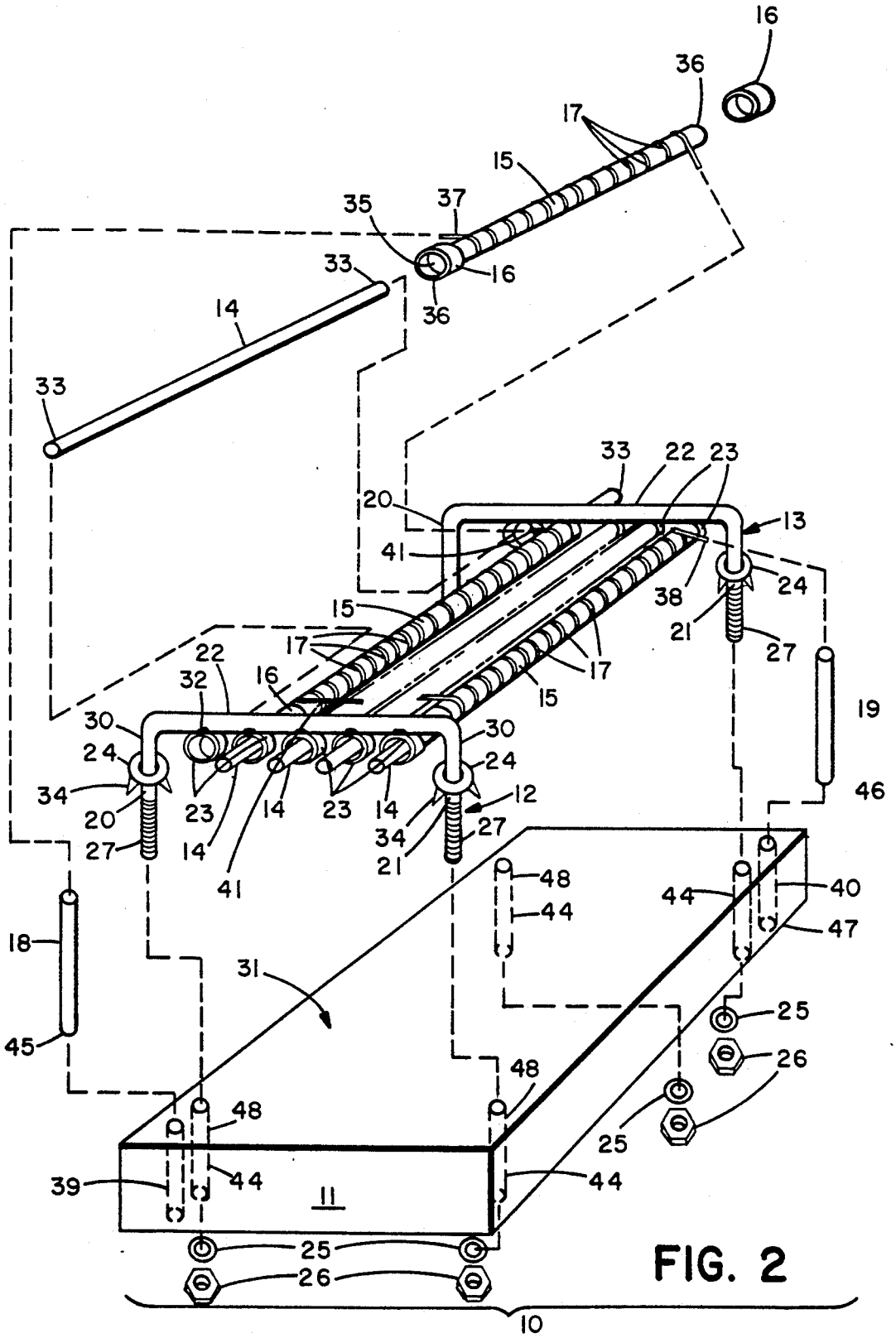
FIG. 2 is an exploded perspective view of the heating unit shown in FIG. 1.

Referring to the drawings, particularly FIGS. 1–4 and 6, there is shown a modular electric heating unit 10 constructed in accordance with the invention.

In general terms, heating unit 10 comprises a body or insulating (Gyro) block member 11, a pair of spaced apart support hangers 12,13 an inner support tube or beam member 14, an outer tube member 15, a pair of spacer members 16, an electrical heating coil 17 and electrical connectors 18,19.

Insulating block member 11 may be made from any suitable material such as an alumina silicate insulation board. Typically, block member 11 is vacuum formed, for example, from ceramic fibers to form a block or other desired shape with a thickness ranging from a few inches to a foot or more depending on the insulation requirements of the furnace. Insulating block member 11 preferably is made of fibrous material comprising interlocked refractory ceramic fibers compacted to a density providing the block member 11 with an optimization of low heat conductivity and low radiation transmission. The material described is commercially available and is available in various forms from the Kanthal Corporation.

Support hangers 12,13 have a somewhat U-shape with spaced apart rod members 20,21 a horizontal support beam 22, one or more bracket members 23, an anchor member 24 on each respective rod member 20,21, and a pair of washer 25 and nut 26 locking means dimensioned for being secured to a respective treaded end portion 27 of a respective rod member.

The rod members 20,21 are dimensioned such that their length from the anchor member 24 to the treaded end portion 27 are equal to or greater than the thickness of block member 11. The length of rod members 20,21 and the length of the treaded end portions 27 are selected so that when assembled a protruding portion 28 of the treaded end portion 27 is provided to accommodate mounting to a furnace wall.

Support beam 22 is spaced a predetermined distance 29 above block member 11 by means of selecting the length of upper portion 30 of rod member 20,21. This spacing is selected so that when heating unit 10 is assembled, heating element 17 is spaced relatively distally from the top surface 31 of insulating block member 11. In this manner, the efficiency of the heating elements 17 are relatively improved over prior art systems. Basically, this improved efficiency is achieved by means of projecting or mounting heating elements 17 outwardly from insulating block 11 and more fully exposing heating element 17 to the environment or air flow within the furnace to improve radiant heat exchange.

Bracket member 23 contains one or more generally ring shaped portions which are affixed, for example, by means of welding 32. Bracket members 23 may be formed of steel or ferritic material or other suitable material from an elongate bar which is contoured by bending to provide one or more a hanging ring shaped brackets 23 dimensioned to mountingly receive an end portion 33 of the inner support tubes 14.

Anchor member 24 is a washer like member with downwardly directed clamping tabs 34. Anchor member 24 may be formed of steel or an alloy or a ferritic material such as FeCrAl alloy and is affixed, for example, by welding to a respective rod member 20,21.

Washer 25 and nut 26 may be of conventional design and are sized for being placed on the treaded end 27 of a respective rod member 20,21.

Inner support tube 14 generally comprises an elongate ceramic tube. Although inner support tube or member 14 is generally made from a ceramic tube or pipe like structure, it is conceivable that other suitable materials and shapes may be utilized. Inner support member 14 is dimensioned so that its length is greater than the distance between the pair of support hangers 12,13 and at least its end portions 33 are sized to enable insertion into aligned bracket ring members 23 of each spaced apart support hanger 12,13. The thickness of the inner tube 14 walls may be imperically selected to provide the desired support strength for the designed load effect and spacing between support hangers 12,13. One of the features of the assembly is the use of such inner support members 14 which can be readily removed, i.e., pulled out, from being mounted within its respective ring members 23 to enable replacement of a respective heating element. This feature of the invention which provides relative ease and lower cost replacement of defective heating elements 17 will be discussed in more detail hereinafter.

Outer tube member 15 generally has an elongate tube like shape with its inner opening 35 of a size to accommodate the insertion of inner tube member 14 therein.

The length of outer tube member 15 is generally somewhat shorter than the distance between the respective pair of spaced apart support hangers 12,13. Outer tube member 15 may be formed from a ceramic tube or other suitable material. The outer diameter size of outer tube member 15 is selected to supportingly receive wrapped thereabout a respective heating element or coil 17. In this manner, a dual support (tubes 14, 15) system is used to provide support strength and to enable easy assembly and disassembly, e.g., replacement of defective heating coils.

A spacer member 16 is provided at each end of a respective outer tube member 15. Spacer member 16 basically comprise a ring shaped ceramic insulator which is dimensioned for being placed over a respective end portion 36 of an outer tube member 15. Spacer members 16 are provided to inhibit contact between hangers 12,13 and its respective electrical heating coil 17.

Each electrical heating coil 17 is a metallic wire like element which is wrapped around a respect outer tube member 15. Generally speaking, there are two main types of resistance alloys used today to form heating coils. The two types of alloys have their own specific properties, with advantages and disadvantages. Both types are commercially available from the Kanthal Corporation under the trade names of NIKROTHAL (which is a nickel-chromium alloy), KANTHAL and ALKROTHAL (which are iron-chromium-aluminium alloys).

In general, the iron-chromium-aluminum alloy heating elements are preferred and provide important advantages such as high temperature capability ranging to 1400 C. (2550 F.) and higher. For the furnace user, this means less material at a lower price.

An important feature of the present invention is the combination of such high temperature heating elements or coils with a new and improved dual tube and hanger support system/assembly. In this manner, the prior art problems of element creeping, bunching and, consequently, failure are substantially reduced or eliminated. In addition, as noted previously, the modular heating units or blocks 10 may be physically oriented vertically and horizontally with relative ease.

The heating coils 17 are generally inter-connected 41 in series circuit and are connected, for example, welded, at opposite ends to respective electrical connectors 18,19. Electrical terminal connectors 18,19 are metal conductor rods or wire which are affixed to or inserted through a hole portion 39,40, respectively, of the insulating block member 11. Each electrical connector 18,19 is in turn connected, in conventional manner, to an electrical power source to enable electrical current to flow through the heating coils 17.

Figure 4:
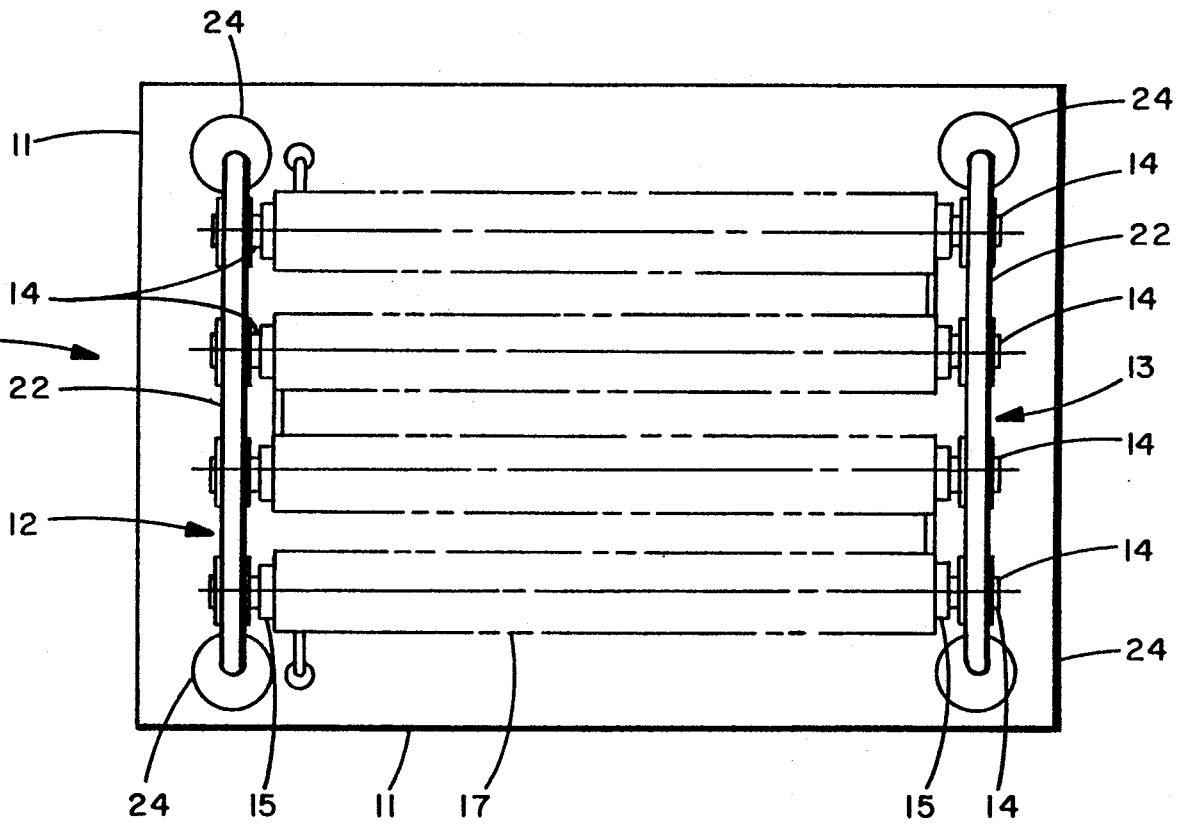
FIG. 4 is a top plan view of the modular heating unit shown in FIG. 3.
Figure 3:
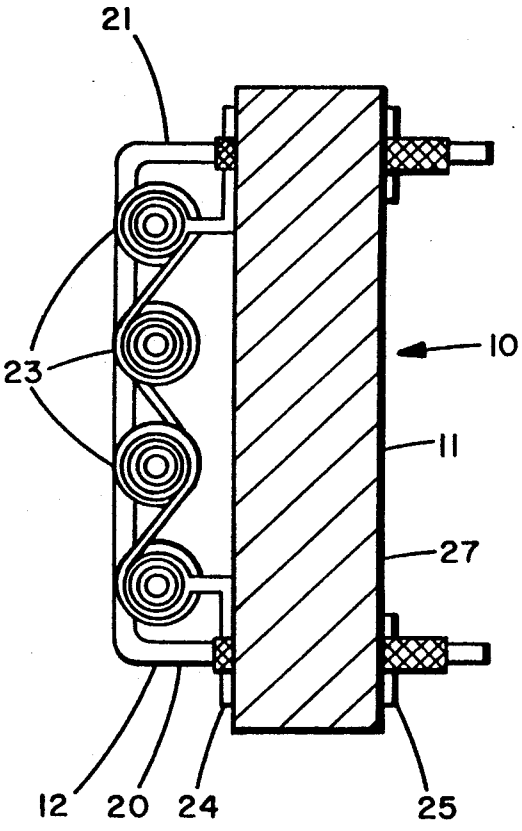
FIG. 3 is a cross-sectional side view of the heating unit assembled in accordance with the invention.
Figure 5:
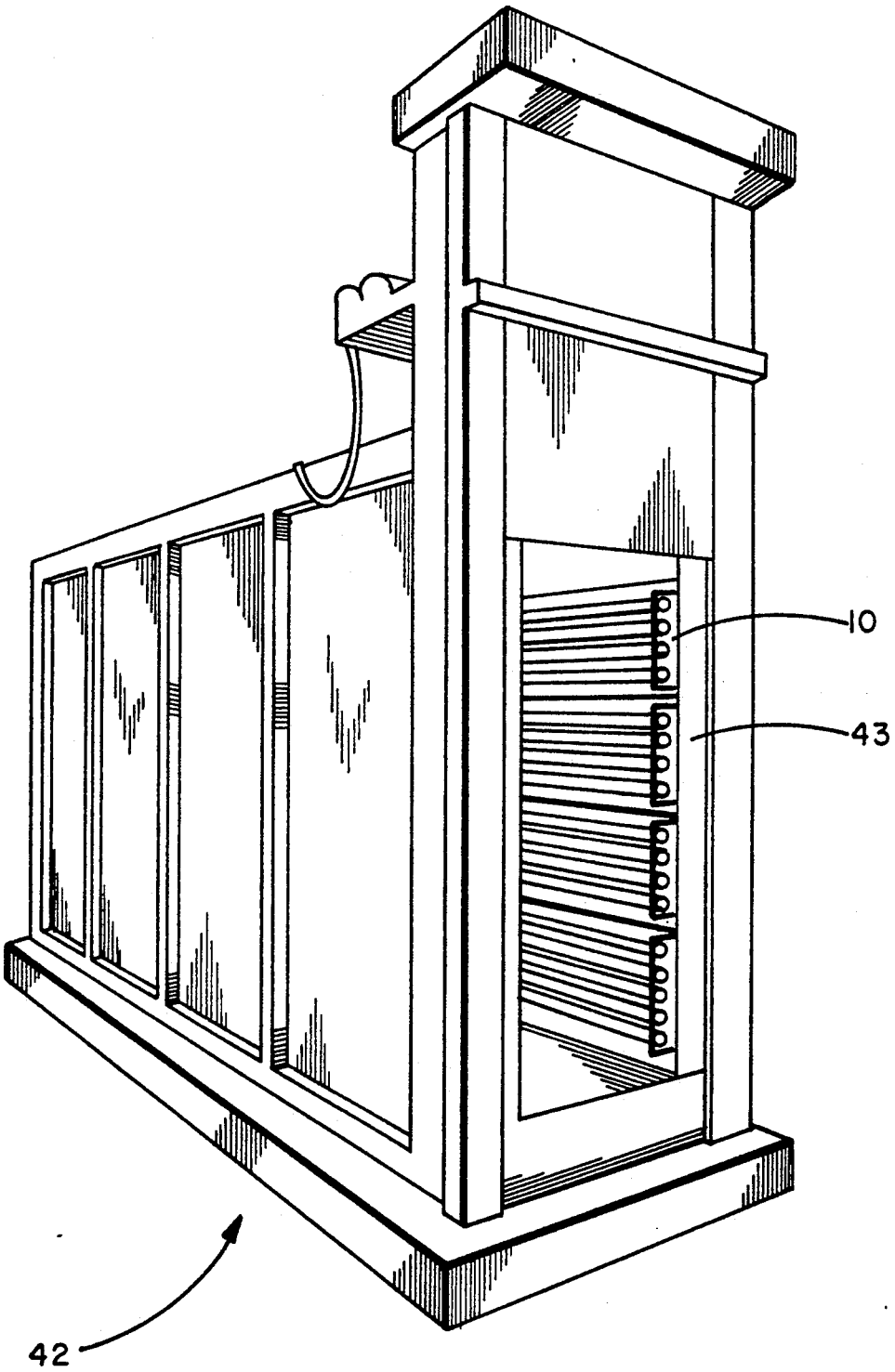
FIG. 5 is a perspective view of a furnace equipped with a plurality of modular heating units assembled in accordance with the invention.
Figure 6:
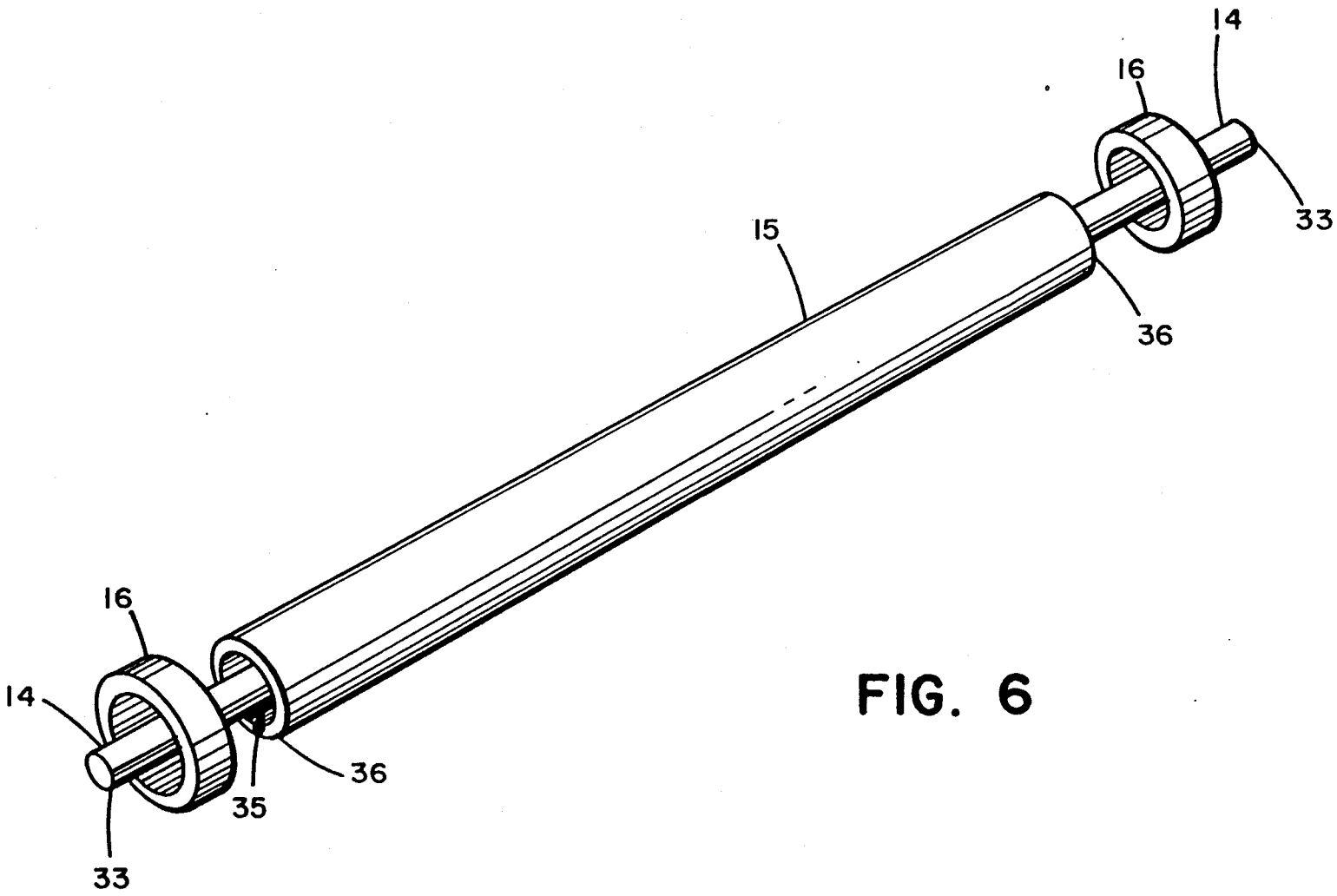
FIG. 6 is an exploded view of the duel rod/tube supports in accordance with the invention.

With reference now to FIG. 4, the use of heating unit 10 within an electrical type furnace 42 is illustrated. Basically, each unit 10 is mounted to the wall(s) 43 and/or ceiling, not shown, of furnace 42. Each heating unit 10 may be affixed to the furnace 42, for example, by means of bolting the protruding treaded end 28 of each rod member 20,21 to the furnace walls 43 and ceiling etc. in conventional manner, i.e., use of nuts (not shown) or other suitable means. Thus, the use of unitary rod members 20,21 to support each insulating block member 11 and the pair of hangers 12,13 of each respective heating unit 10 provides relatively improved structural support for each heating unit 10.

ASSEMBLY-DISASSEMBLY

Generally, hangers 12,13 with attached bracket members 23 are heat treated prior to assembly in a manner so as to provide improved characteristics when used in a furnace.

As previously noted, insulating block member 11 has holes 44 therein for snugly receiving a portion of a respective rod member 20,21.

A pair of hangers 12,13 are mounted in spaced aligned relationship on a block member 11, with each rod member 20,21 being inserted through a respective hole 44 of a block member 11.

A washer 25 and nut 26 are then placed on the protruding treaded end 27 of each rod member 20,21 and tightened to cause the clamping tabs 34 of respective anchor members 24 to grip or be embeded into the insulating block member 11. In this manner, a ridget support or clamping of the aligned pair of spaced apart hangers 12,13 with the insulating block member 11 is effected.

Next, each electrical heating coil 17 is mounted on a respective outer tube member 15 to form a plurality of series connected heating coils 17, with said group or gang of heating coils 17 having a terminating end connector 18, 19 at the opposite ends of the series connected group of heating coils 17.

The group of heating coils 17 and respective outer tube members 15 are disposed between the pair of hangers 12,13 with each outer tube member 15 being aligned between two spaced apart bracket members 23.

A spacer member 16 is mounted on each end of a respective outer tube member 15 to provide constraint of lateral movement of the respective heating coil 17.

An inner tube member 14 is then inserted at one end through the hanger 12, passing through the center hole 35 of outer tube member 15 and then into the opposite aligned hanger 13. In this manner, the inner tube member 14 is supported between two aligned hangers 12,13 with the heating coil 17 and outer tube member 15 being mounted on/about the inner tube member 14 and each spacer member 16 forming a ring between a hanger 12,13 and a respective end of a heating element 17.

The two ends of the inter-connected group of heating elements, i.e., terminal connectors 37 and 38, are connected, for example, welded, to a respective electrical connector rod or wire 18 and 19. The other end 45 and 46 of electrical connector rods 18 and 19 are connectable to an electrical power source (not shown) in conventional manner.

If a failure occurs in one of the heating coils, it may be replaced relatively quickly and inexpensively as described below. For example, with power removed from the heating unit 10, the connecting wires, i.e., input and output leads, 37 and 41 of the defective coil is cut or disconnected. Next, the respective inner tube 14 for the defective heating coil is slidingly by pulled out of the respective two aligned bracket members from one side of the heating unit. In this manner, the defective heating coil mounted on its supporting outer ceramic tube is isolated and can be manually removed from the heating unit. A new replacement heating coil mounted on an outer ceramic tube with end spacer members is then inserted into position vacated by the removed defective heating coil. The inner ceramic tube is slidingly inserted from one side through the respective near bracket member and the inner hole 35 of the outer ceramic tube 15 and into the aligned bracket member on the other side of heating unit 10, so that the new heating coil is supported in similar manner to the other heating coils mounted on the heating unit 10. Finally, the terminal ends 37 and 41 are connected, for example, welded, to the cut leads/connector, respectively, thereby re-establishing the electrical series connection of all the heating coils of the heating unit.

While there has been shown what is considered to be the preferred embodiment of the invention, it is desired to secure in the appended claims all modifications as fall within the true spirit and scope of the invention.

What is claimed is:

1. A modular type heating unit having particular utility for use in a furnace, comprising:

an insulating body member (11);

a pair of spaced apart aligned support hangers (12, 13) each having one or more bracket members (23) affixed to a respective support beam (22), and each having a pair of rod members (20, 21) mounted to said body member and being dimensioned for supporting its respective support beam relatively distally from said body member;

a dual support system having a discrete inner support member (14) comprising a ceramic tube or rod with a diameter selected to enable its end portions (33) to be removably inserted into a respective one of said bracket members of each said aligned support hanger to facilitate assembly/disassembly of each dual support system from a respective pair of bracket members, and having a discrete outer support member (15) comprising a ceramic tube having surfaces defining a tube hole extending longitudinally the length of said outer support member and dimensioned for removably receiving said inner support member (14) so that said outer support member is supported by said inner support member; and an electrical heating element (17) mounted on said outer support member.

2. A heating unit as in claim 1, wherein:

the insulating body member is formed from insulating fibrous material to a predetermined size and shape.

3. A heating unit as in claim 1, wherein:

said support hangers are formed from an alloy of iron-chromium-aluminium.

4. A heating unit as in claim 1, wherein:

said support hangers are formed from an alloy of nickel-chromium.

5. A heating unit as in claim 1, wherein:

said support beam (22) and said pair of rod members (20,21) are formed from an elongate bar of alloy comprising iron-chromium-aluminium or nickel-chromium, with the elongate bar being contoured to form said support beam having a selected length and bent on each side to form aligned projecting rod members having a predetermined length.

6. A heating unit as in claim 1, wherein:

said bracket member being formed of any suitable material and having a generally ring shape defining a hole therein dimensioned for supportingly accommodating a respective end portion of said inner support member.

7. A heating unit as in claim 1, including:

a plurality of discrete anchor means (24) with each anchor means being affixed to a respective one of said rod members and disposed for engaging a portion of said body member for rigidly clamping said body member to said support hangers.

8. A heating unit as in claim 1, including:

a threaded end portion (27) on an end portion of each said rod member and a nut locking means (26) for mating engagement with said treaded end portions for clamping said hangers to said body member.

9. A heating unit as in claim 1, including:

a pair of electrical terminal connectors (18,19) mounted to said body member with each said electrical terminal connector being coupled to a respective end (37,38) of said electrical heating elements.

10. A heating unit as in claim 1, including:

an insulating spacer means (16) on each side of said electrical heating element for preventing contact between said electrical heating element with said support hangers.

11. A heating unit as in claim 1, wherein:

said support beam and said rod members and said electrical heating element are each formed substantially from the same metallic alloys to exhibit substantially similar charcteristics to exposure to substantially high temperatures.

12. A heating unit as in claim 1, wherein:

said support beam and said pair of rod members are formed from a unitary bar of electric resistance alloys comprising nickel-chromium or iron-chromium-aluminium, which is heat treated to enhance strength by grain transformation prior to said heating unit being assembled whereby warping and creep elongation are substantially reduced.

13. A heating unit as in claim 1, wherein:

said rod members being dimensioned in order to dispose said bracket members (23) a predetermined distance above a top surface portion (31) of said body member to facilitate air flow over said electrical heating element.

14. A modular heating unit for use in an electric type furnace, in combination comprising:

a block member (11) formed of suitable insulating fibers having a thickness between one inch and twenty-four inches, and having a top surface (31) and a bottom surface (47) of predetermined dimensions, said block member having wall members (48) defining a plurality of hanger mounting holes (44) each extending through said block member and a first and a second terminal connector hole (39,40);

a pair of spaced apart and aligned support hangers (12,13) each having a support beam (22) and a pair of downwardly protecting rod members (20,21) with each said rod member having a furnace wall mounting end portion (28), said rod members each being dimensioned so that with each rod member being inserted at the top surface of said block member into a respective hanger mounting hole a section of said furnace mounting end portion of each rod member extends outwardly from the bottom surface of said block member with each respective support beam being substantially spaced above the top surface of said block member, said support hangers being formed of resistance heating alloys;

at least one bracket member (23) affixed to each support beam of said pair of support hangers to form a pair of aligned bracket members;

at least one tube shaped ceramic outer support member (15) having wall portions defining an inner tube hole (35) extending through the length thereof and dimensioned for being disposioned between said pair of aligned bracket members;

a pair of insulating ceramic ring shaped spacer members (16) with each one of said pair of spacer members being mounted on the opposite ends of said outer support member;

an electrical heating coil means (17) formed of metallic alloys substantially similar to the support hangers and having coil members mountingly wrapped about said outer support member between the respective pair of spacer members and being capable of electrical energization for emitting radiant heat, at least one tube shaped ceramic inner support member (14) dimensioned for being inserted through the inner tube hole of said outer support member and having its opposite ends (33) being mounted to a respective bracket member of said pair of aligned bracket members;

whereby said heating coil means may be mounted to the furnace without the loading effect being placed on said block member and with substantially improved air flow and uniform heat radiation from said heating coil.

* * * * *